United States Patent [19]

Holmes

[11] Patent Number: 4,651,826

[45] Date of Patent: Mar. 24, 1987

[54] OIL RECOVERY METHOD

[75] Inventor: Billy G. Holmes, Lancaster, Tex.

[73] Assignee: Mobil Oil Corporation, New York, N.Y.

[21] Appl. No.: 692,133

[22] Filed: Jan. 17, 1985

[51] Int. Cl.[4] ..... E21B 43/243

[52] U.S. Cl. ..... 166/251; 166/256

[58] Field of Search ..... 166/256, 258, 260, 261, 166/251

[56] References Cited

U.S. PATENT DOCUMENTS

| | | | |
|---|---|---|---|
| 2,771,951 | 11/1956 | Simm | 166/256 |
| 2,818,117 | 12/1957 | Koch | 166/256 |
| 3,047,064 | 7/1962 | West et al. | 166/256 X |
| 3,138,203 | 6/1964 | Weiss et al. | 166/251 |
| 3,182,721 | 5/1965 | Hardy | 166/251 X |
| 3,198,249 | 8/1965 | Willman | 166/251 |
| 3,332,488 | 7/1967 | Wilson | 166/251 X |
| 3,964,546 | 6/1976 | Allen | 166/261 |
| 4,042,026 | 8/1977 | Pusch et al. | 166/258 |
| 4,263,970 | 4/1981 | Cha | 166/261 |

*Primary Examiner*—Stephen J. Novosad

*Attorney, Agent, or Firm*—Alexander J. McKillop; Michael G. Gilman; Charles A. Malone

[57] ABSTRACT

The combustion front in an in situ combustion oil recovery operation is stabilized by cyclically varying the injection rate of the gaseous oxidant which is injected through the injection well. Periodic reduction in the injection rate of the oxidant halts the advance of the combustion front through the formation and permits the formation fluids to flow in a reverse direction back towards the front so that burned through fingers or streaks collapse and any overriding tendencies of the front are corrected. In this way, the vertical conformance of the front is increased to improve the sweep efficiency of the process. The process is most effective in externally pressured formations.

28 Claims, 2 Drawing Figures

OIL RECOVERY METHOD

FIELD OF THE INVENTION

This invention relates to the recovery of oil from subterranean, oil-bearing formations and more particularly, to a thermal oil recovery process employing in situ combustion.

BACKGROUND OF THE INVENTION

In the recovery of petroleum from subterranean reservoirs, it is usually possible to recover only a portion of the oil which is originally in place in the reservoir by the so-called primary recovery methods, that is, methods that utilize the formation energy for the production of the oil. A variety of supplemental recovery techniques, generally referred to as enhanced oil recovery processes, have been employed in order to increase the proportion of oil which is recovered. In these techniques, energy is supplied to the reservoir to provide a driving force for increasing the amount of oil which is recovered. Thermal recovery methods such as in situ combustion (fire flooding) are one type of process for recovering oil in this way and they are particularly suitable for the recovery of heavy or viscous petroleum deposits from tar sands and other reservoirs which cannot be economically produced in other ways.

The most common in situ combustion technique is the concurrent or forward burn process in which an injection well and a production well are driven into the subterranean, oil-bearing formation and the hydrocarbons in the formation are ignited around the injection well. An oxygen-containing gas such as air, oxygen-enriched air or substantially pure oxygen is then injected into the formation through the injection well to support burning of the hydrocarbons in the formation. A combustion front is established in the formation around the injection well and as the combustion process continues, this front advances through the reservoir in the direction of the production well. Preceding the combustion front is a high temperature zone, commonly referred to as a "retort zone" within which the reservoir oil is heated to effect a viscosity reduction and in which it is also subjected to various thermal processes such as distillation and cracking. Hydrocarbon fluids, including the heated crude oil and the distillation and cracking products of the crude, are then displaced towards the production well from which they may be withdrawn to the surface.

Carbon dioxide is formed as one of the products of combustion and as the combustion front advances through the formation, the generated carbon dioxide is displaced through the formation towards the production well and as it is displaced towards the production well, it dissolves in the reservoir oil, reducing its viscosity and consequently, improving its mobility. Thus, there are a number of different effects which contribute to the improved recovery of the oil during the process, including thermal viscosity reduction, distillation, cracking and carbon dioxide solution drive. Because these effects are particularly useful when the crude oil in the reservoir is a viscous, heavy oil, in situ combustion has commended itself for use in reservoirs, e.g. tar sands, which contain this type of oil.

In order to maximize the sweep efficiency of the process, it is desirable for the combustion front to advance through the formation in a uniform manner, preferably with the front remaining vertical during its progress from the injection well towards the production well. However, this ideal condition is unlikely to be achieved in practice for a number of reasons. First, the oxygen-containing gas tends to penetrate the formation in narrow streaks or fingers in which combustion takes place ahead of the main combustion front. If these fingers penetrate rapidly towards the production well they may provide a path along which oxygen can travel directly from the injection well to the production well without supporting any further significant degree of combustion in the formation. Also, these fingers promote instability in the combustion front which may make its progress less uniform and predictable than would be desirable. Another problem is that the combustion front tends to move faster at the top of the reservoir than at the bottom because the oxygen-containing gas, the combustion products and the hydrocarbons released by the process tend to be less dense than the crude oil in the reservoir; they therefore rise and travel across the top of the reservoir while the unaffected crude oil remains at the bottom of the reservoir, particularly in the region of the production well. Because these problems tend to decrease the sweep efficiency of the process, i.e., the efficiency with which the oil is displaced from the reservoir, it would be desirable to stabilize the combustion front and make its progress through the reservoir more predictable and uniform in character.

SUMMARY OF THE INVENTION

It has now been found that the combustion front may be stabilized and displacement of the oil from the formation improved by making a cyclical variation in the amount of oxygen-containing gas which is injected into the formation. The amount of the oxygen-containing gas is periodically reduced from the quantity necessary to maintain the advance of the combustion front through the formation to a lesser amount, typically 5 to 20% of the normal amount, so that while the combustion is still maintained, the front is stabilized and vertical conformance improved so that improved displacement of the oil is obtained. Reduction of the oxidant flow reduces the gas saturation in the formation, permitting liquids flow to the production well to increase, with consequent improvements in recovery.

According to the present invention, therefore, a process for the recovery of oil from a subterranean, oil bearing formation, employs an in situ combustion operation in which an oxygen-containing gas is injected into the formation through an injection well to initiate and maintain a combustion front which advances through the formation from the injection well towards a production well from which oil is recovered. The injection rate of the oxygen-containing gas is reduced whenever necessary to stabilize the combustion front in the course of its progress from the injection well towards the production well. When the front has been stabilized, injection of the oxygen-containing gas may be resumed at the original rate so that the front can continue its advance through the formation.

THE DRAWINGS

In the accompanying drawings:

FIG. 1 is a simplified vertical section of an oil reservoir undergoing an in situ combustion recovery operation; and FIG. 2 is a simplified vertical section of the reservoir, showing the effect of reducing the rate of oxidant injection.

DETAILED DESCRIPTION

Figure 1:
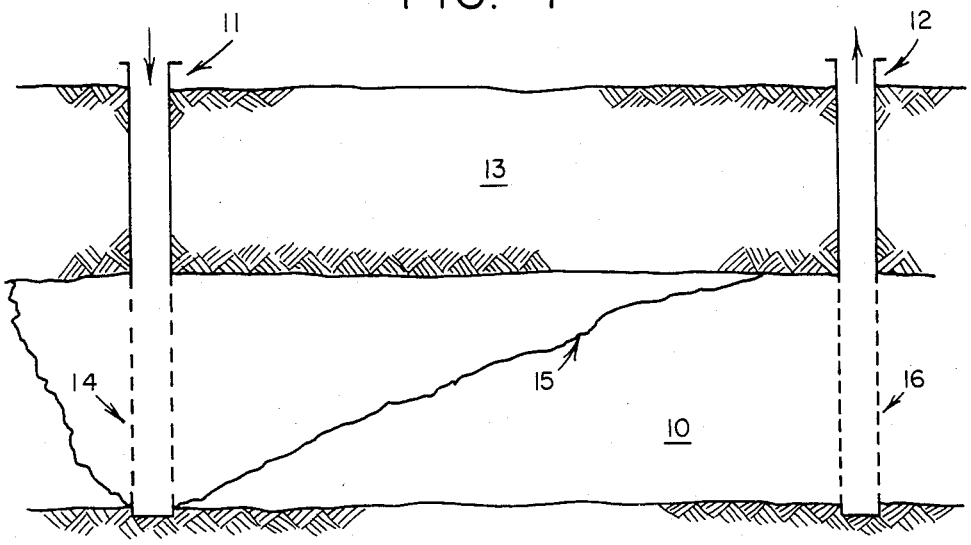

The present in situ combustion process is particularly useful in the recovery of viscous, heavy oils such as viscous petroleum crude oil, for example, those which have a gravity of API 15 or lower and the heavy, viscous tar-like hydrocarbons which are present in tar sands although it may also be used with other oils. The formation containing the oil is penetrated by one or more injection wells and one or more production wells which extend from the surface of the earth into the reservoir. The production wells are each located at a horizontal distance or offset from an injection well, both the injection and production wells being positioned in a pattern which is appropriate to the terrain and other factors. For example, the wells may be arranged in a line drive pattern in which a number of injection wells and production wells are arranged in rows which are spaced from one another. Alternatively, a number of production wells may be spaced around a central injection or a number of injection wells may be spaced around a central producing well. Typical of such well arrays are the five spot, seven spot, nine spot and thirteen spot patterns and their inverted forms. These and other patterns for in situ combustion operations are conventional in themselves. For the purpose of simplicity, the present process will be described below with reference to only one injection well and one production well in the recovery pattern but in practical applications of the process, a number of injection wells and production wells will normally be used, as described above.

A gaseous oxidant is injected into the formation through the injection well in order to support the combustion process. This oxidant is a molecular oxygen-containing gas such as air, oxygen-enriched air or substantially pure oxygen, of which substantially pure oxygen is preferred because it promotes rapid combustion of the hydrocarbons in the crude oil, reduces the volume of gas which has to be injected and avoids the introduction of inert, insoluble gas phase such as nitrogen into the reservoir system which might otherwise compete with the carbon dioxide in the combustion products for pore space in the reservoir. If oxygen-enriched air is to be used, it preferably contains at least 75 volume percent oxygen.

Combustion of the formation oil is initiated around the injection well and continued injection of the oxidant establishes a combustion front which advances through the formation towards the producing well. As the combustion front advances through the formation, the gaseous combustion products, principally carbon dioxide and water, are driven through the reservoir ahead of the combustion front and the heated retort zone which precedes it. As mentioned above, the crude oil in the reservoir undergoes a thermal reduction in viscosity together with other processes such as distillation and cracking which result in various low viscosity hydrocarbons being released into the formation ahead of the combustion zone. Together with the combustion products they are driven towards the producing well, functioning as heating and displacing fluids. The carbon dioxide produced by the combustion process tends to dissolve in the various hydrocarbon liquids present in the reservoir to produce a low viscosity phase of improved mobility which is readily displaced towards the production well.

Injection of the oxidant through the injection well and the removal of oil and other fluids from the production well establishes a pressure gradient in the formation, with a higher pressure in the region of the injection well and a relatively lower pressure around the production well. This pressure gradient is one of the factors which promotes instabilities in the combustion front because the high pressure oxygen behind the front will tend to penetrate towards the region of low pressure surrounding the production well, particularly in regions of relatively higher permeability in the formation. In this way, fingers or streaks are initiated in the formation through which the oxygen travels rapidly, supporting combustion in the region immediately surrounding the streak but without promoting a broad, planar advance of the combustion front. If a sufficient number of these streaks should penetrate to the production well, a high permeability path will be established directly between the injection and production wells through which the oxygen can travel without promoting any significant degree of combustion in the formation, resulting in losses of oxygen to the process. In addition, because the oxygen, the gaseous combustion products and the low viscosity oil phases are generally of lower density than the original crude, they tend to rise towards the top of the reservoir during their movement towards the production well. As the process proceeds, the effect of this is to cause a general upward movement of the combustion front and its products in the reservoir so that a portion of the crude oil in the formation will be bypassed unless measures are taken to correct the situation. This is the familiar problem of "override".

Figure 2:
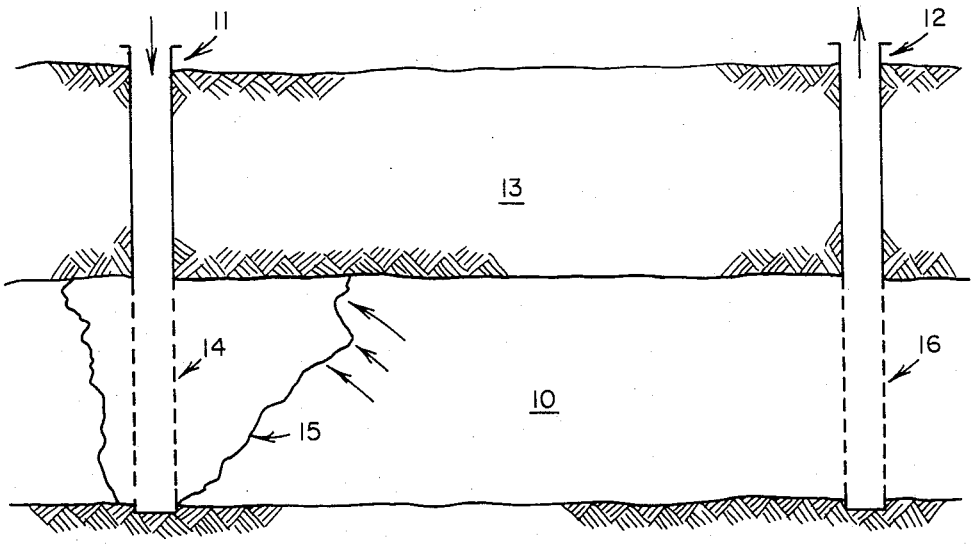

It has now been found that if the injection rate of the gaseous oxidant is cyclically or periodically reduced, the combustion front is stabilized and displacement is improved. This may be explained by reference to the accompanying drawings in which FIG. 1 shows, in simplified form, a vertical section of a subterranean formation in which an in situ combustion operation is being carried out. In FIG. 1, the oil-bearing formation 10 is penetrated by an injection well 11 and a production well 12 which extend into the formation from the surface of the earth through the overburden 13. The gaseous oxidant is injected through injection well 11 and passes out of the injection well through perforations 14 into formation 10. The oxidant then passes through the formation until it reaches the region where combustion front 15 is progressing through the formation towards production well 12. The products of the combustion, including the oil released from the formation enter production well 12 through perforations 16. As can be seen from FIG. 1, the combustion front 15 extends in an irregular manner from injection well towards production well 12 with an overall tendency to override the lower portions of the formation which are nearer production well 12. In addition, a number of fingers or streaks are developing in which the oxygen is penetrating the formation rapidly in a number of narrow channels. In order to stabilize the combustion front, the injection rate of the oxidant is periodically reduced, typically to a value of 5 to 25%, preferably 5 to 15% of the normal injection rate, so that the advance of the combustion front through the formation is checked. When this takes place, the pressure gradient in the formation in which the pressure normally decreases from the region of the injection well towards the production well, is reduced or even partly reversed so that a reverse flow tendency is set up in the formation. When this takes place, the formation fluids which are present in the reservoir ahead of the combustion front flow backwards towards the front and enter the region around it, as indicated by the arrows in FIG. 2, and push the front backwards to restore it to a more vertical, planar configuration while, at the same time, penetrating into the burned-through streaks formed by channeling of the oxygen into the formation ahead of the combustion front. Thus, not only is the general configuration of the combustion front brought into better vertical conformance for greater sweep efficiency but the reverse flow of the formation fluids causes the burned-through fingers or streaks to collapse as the pressure in the burned zone decreases and equilibrates with the surrounding formation pressure.

Because the combustion front is stabilized by a reverse flow of the formation fluids, the method will work best in formations which are pressurized from an external source, for example, an aquifer which will tend to maintain formation pressure at its original value as the fluids are withdrawn through the production well or in operations where the same effect is obtained by water injection. However, the method will also achieve improvements in formations which are not externally pressured. The front stabilization operation may be carried out as often as necessary in order to improve operation of the combustion process and the frequency with which it is carried out will depend upon the progress of the recovery and this, in turn, will depend upon a number of factors including formation permeability distribution, thickness of the production interval, well spacing, oxidant injection rate, oil saturation, reservoir pressure and so forth. The progress of the combustion operation may be determined by monitoring the combustion products from the production well and by periodically measuring the production rate of oil and other fluids. If the proportion of carbon dioxide in the gaseous combustion products is relatively high, with only a small amount of carbon monoxide, it may be assumed that the combustion is generally of a high quality. If quantities of unreacted oxygen are found in the produced gas, it may be inferred that fingers or streaks of oxygen are penetrating the formation ahead of the main combustion front, permitting the oxygen to reach the production wells ahead of the main front. The production rate of oil will indicate whether actual displacement of the oil by the combustion operation is occurring. If it is found, for example, that there is only a limited response to a high quality burn, it may be inferred that the combustion front may be bypassing the displaced oil, as shown in FIG. 1, with the combustion front overriding the oil which remains in the lower portion of the reservoir. If this is thought to be occurring, it may be appropriate to stabilize the combustion front by reducing the oxidant flow for a period of time until a more vertical front configuration is achieved. When this has been done, the full rate of oxidant flow may be resumed so that the progress of the combustion front through the formation is renewed but this time with a more vertical configuration to the front so that the sweep efficiency is improved. At this time, it should be found that oil production is increased, indicating that less of the formation is being bypassed. Injection at the full rate may then be continued until monitoring of the operation indicates that front stabilization is again necessary. Generally, the stabilization of the combustion front in this way can be achieved over a period of time typically ranging from one to four weeks although this will be dependent upon a number of factors including thickness of the production interval, formation porosity, viscosity of the crude and so forth, indicating that stabilization of the front should be determined empirically in each case. If air is used as the oxidant, the cycles may last rather longer because of the greater amount of gas used to bring about the same extent of combustion; in this case, the reduced injection rate may prevail for periods typically up to six months.

The combustion operation may be carried out as a wet combustion operation in which steam or water is injected together with the gaseous oxidant in order to enhance heat transfer to the formation and the crude oil which it contains. However, this is not essential for the operation. Wet combustion is particularly desirable in formations which are not externally pressured in order to restore the fluid balance in the reservoir.

When the injection rate of the oxidant is reduced, the gas saturation in the formation decreases and the concomitant increase in liquid (oil, water) saturation leads to an increase in the rate of liquids production. At the same time, fluid saturation is re-established in the areas where the oxygen has penetrated into the reservoir ahead of the main combustion front. In this respect, the effect of the stabilization procedure will be similar to that of the WAG (water alternating gas) process in which the invasion of the carbon dioxide gas into the oil saturated formation pores is enhanced by the following water slug except that in the present case, the invasion of the gas is enhanced by the flow of the formation fluid back into the burn zone. When the rate of oxidant injection is increased once again, the instabilities in the front may recur although not necessarily in the same place but in the meantime the flow of oil to the production well is facilitated by the decreased gas flow.

The invention is illustrated by the following Example:

EXAMPLE

An in situ combustion operation was carried out in an oil-bearing formation having the characteristics set out in Table 1 below:

TABLE 1

| Formation Properties | |
|---|---|
| Area, acres | 7.0 |
| Net Pay, ft | 40 |
| Porosity, % | 30 |
| Oil Saturation, % | 40 |
| Specific Oxygen Req., MMSCF/acre-ft | 2.0 |
| Specific Fuel Req., BBLS/acre-ft | 200.0 |
| Present Oil Saturation, BBLS/acre-ft | 930.0 |
| Total $O_2$ Injected, MMSCF | 34.0 |
| Total Volume, acre-ft | 280.0 |
| Fuel Saturation, % PV | 8.6 |

The in situ combustion operation, using oxygen as the oxidant, had proceeded to the point where about 17 acre-ft has been burned and about 12,000 BBLS of oil had been thermally displaced, about 6.1% of the pattern volume having been burned. At this point, the produced carbon dioxide content was about 80%, with about 2.5% carbon monoxide present. The high $CO_2/CO$ ratio indicated that a high quality burn was being obtained but small quantities of unreacted oxygen up to 10% were present in the produced gas from some of the production wells. However, no significant increase in the oil production rate was detected, indicating that the oil displaced from the formation by the operation was being bypassed, in the manner shown in FIG. 1.

The oxygen injection rate was reduced from 240 MSCF/day to 20 MSCF/day for two weeks in order to stabilize the front and improve the displacement at which time the oxygen content was reduced to 1% or less with a subsequent increase in production rate of approximately 60%. After this had been done, the oxygen injection rate was raised to its original value of 240 MSCF/day.

I claim:

1. A method for preventing gravity override while recovering viscous oil from an oil-bearing, subterranean reservoir containing said oil penetrated by an injection well and a spaced apart production well, comprising;

(i) establishing a combustion front in the reservoir adjacent the injection well by the initiation of an in situ combustion in the reservoir;

(ii) injecting continuously a gaseous oxidant into the reservoir through the injection well to support the in situ combustion, which combustion front advances in a substantially lateral manner;

(iii) determining that fingers or streaks of oxygen are penetrating the formation ahead of the main combustion front;

(iv) in response to said determining step, reducing the rate at which the gaseous oxidant is injected into the formation through the injection well to stabilize the combustion front;

(v) thereafter increasing the injection rate of the gaseous oxidant into the reservoir through the injection well; and (vi) recovering fluids including oil from the production well.

2. The method according to claim 1 in which the reduction and the increase in the injection rate of the gaseous oxidant are performed cyclically to stabilize the combustion front periodically.

3. The method according to claim 1 in which the gaseous oxidant comprises oxygen.

4. The method according to claim 1 in which the reservoir is pressurized from a natural external source within the reservoir which tends to maintain formation pressure at its original value.

5. The method according to claim 1 in which the injection rate of the gaseous oxidant is reduced to an extent that formation fluids from the region ahead of the combustion front flow back towards the combustion front.

6. The method according to claim 1 in which the injection rate of the gaseous oxidant is reduced to 5 to 25% of the rate prior to reduction.

7. The method according to claim 6 in which the injection rate of the gaseous oxidant is reduced to 5 to 15% of the rate prior to reduction.

8. The method according to claim 1 in which the formation is pressurized.

9. In a method for preventing gravity override while recovering oil from an oil-bearing, subterranean reservoir penetrated by an injection well and a production well by injecting continuously a gaseous oxidant into the formation through the injection well to support an in situ combustion in the reservoir with a combustion front advancing from the injection well towards the production well to displace oil from the formation towards the production well, and recovering oil from the production well, the improvement which comprises:

cyclically varying the injection rate of the gaseous oxidant to stabilize the combustion front and thereby prevent said gravity override.

10. The method according to claim 9 in which the injection rate of the gaseous oxidant is cyclically reduced to a lower value to stabilize the combustion front and then increased to a higher value.

11. The method according to claim 10 in which the injection rate of the gaseous oxidant is reduced to 5 to 25% of the injection rate prior to reduction.

12. The method according to claim 11 in which the injection rate of the gaseous oxidant is reduced to a value of 5 to 15% of the rate prior to reduction.

13. The method according to claim 10 in which the injection rate of the gaseous oxidant is increased, after the reduction, to its value prior to reduction.

14. The method according to claim 9 in which the gaseous oxidant comprises oxygen.

15. The method according to claim 9 in which the formation is pressurized from an external natural source within the reservoir which tends to maintain formation pressure at its original value.

16. The method according to claim 15 in which the formation is externally pressured by an aquifer.

17. A method for preventing gravity override while recovering viscous oil from an oil-bearing, subterranean reservoir containing said oil penetrated by an injection well and a spaced apart production well, comprising;

(i) establishing a combustion front in the reservoir adjacent the injection well by the initiation of an in situ combustion in the reservoir;

(ii) injecting continuously a gaseous oxidant into the reservoir through the injection well to support the in situ combustion, which combustion front advances in a substantially lateral manner towards said production well;

(iii) determining that fingers or streaks of oxygen are penetrating the formation ahead of the main combustion front;

(iv) in response to said determining step, reducing the rate at which the gaseous oxidant is continuously injected into said formation through said injection well thereby causing better vertical conformance of said combustion front, said fingers or streaks to collapse, as pressure in a burned zone decreases and equilibrates the surrounding formation pressure;

(v) thereafter increasing the injection rate of the gaseous oxidant into the reservoir through the injection well; and (vi) recovering fluids including oil from the production well.

18. The method as recited in claim 17 where step (iv) is performed over a period of from about 1 to about 26 weeks.

19. The method according to claim 17 in which the reduction and the increase in the injection rate of the gaseous oxidant are performed cyclically to stabilize the combustion front periodically.

20. The method according to claim 17 in which the gaseous oxidant comprises oxygen.

21. The method according to claim 17 in which the reservoir is pressurized from a natural external source within the reservoir which tends to maintain formation pressure at its original value.

22. The method according to claim 17 in which the injection rate of the gaseous oxidant is reduced to an extent that formation fluids from the region ahead of the combustion front flow back towards the combustion front.

23. The method according to claim 17 in which the injection rate of the gaseous oxidant is reduced to 5 to 25% of the rate prior to reduction.

24. The method according to claim 17 in which the injection rate of the gaseous oxidant is increased, after the reduction, to its value prior to reduction.

25. The method according to claim 17 in which the formation is pressurized from an external natural source within the reservoir which tends to maintain formation pressure at its original value.

26. The method according to claim 17 in which the formation is externally pressured by an aquifer.

27. The method according to claim 17 in which the formation is pressurized.

28. The method according to claim 17 where step (iv) is performed over a period of from about 1 to about 26 weeks.

* * * * *